US006437227B1

(12) United States Patent
Theimer

(10) Patent No.: US 6,437,227 B1
(45) Date of Patent: Aug. 20, 2002

(54) METHOD FOR RECOGNIZING AND SELECTING A TONE SEQUENCE, PARTICULARLY A PIECE OF MUSIC

(75) Inventor: Wolfgang Theimer, Bochum (DE)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/686,425

(22) Filed: Oct. 11, 2000

(30) Foreign Application Priority Data

Oct. 11, 1999 (DE) ..... 199 48 974

(51) Int. Cl.[7] ..... A63H 5/00; G04B 13/00; G10H 7/00

(52) U.S. Cl. ..... 84/609; 84/603; 84/616; 84/649

(58) Field of Search ..... 84/600–607, 609–613, 84/622–625, 645, 649–652, 659–660, 615–616; 704/200, 205–208, 231, 235–237, 243, 246–247

(56) References Cited

U.S. PATENT DOCUMENTS

| | | | | |
|---|---|---|---|---|
| 4,354,418 A | * | 10/1982 | Moravec et al. | 84/454 |
| 4,463,650 A | | 8/1984 | Rupert | 84/1.19 |
| 5,402,339 A | | 3/1995 | Nakashima et al. | 364/419.19 |
| 5,616,876 A | | 4/1997 | Cluts | 84/609 |
| 5,728,960 A | | 3/1998 | Sitrick | 84/477 R |
| 5,739,451 A | | 4/1998 | Winsky et al. | 84/609 |
| 5,808,225 A | * | 9/1998 | Corwin et al. | 84/622 |
| 5,874,686 A | | 2/1999 | Ghias et al. | 84/609 |
| 5,963,957 A | | 10/1999 | Hoffberg | 707/104 |
| 5,995,928 A | * | 11/1999 | Nguyen et al. | 704/251 |
| 6,121,530 A | * | 9/2000 | Sonoda | 84/609 |
| 6,246,672 B1 | * | 6/2001 | Lumelsky | 704/260 |
| 6,260,012 B1 | * | 7/2001 | Park | 704/236 |

FOREIGN PATENT DOCUMENTS

| | | |
|---|---|---|
| DE | 19526333 A1 | 1/1997 |
| DE | 19652225 A1 | 6/1998 |
| EP | 0944033 A1 | 9/1999 |

* cited by examiner

*Primary Examiner*—Marlon T. Fletcher
(74) *Attorney, Agent, or Firm*—Perman & Green, LLP

(57) ABSTRACT

The invention relates to methods for recognizing and for selecting a tone sequence, particularly a piece of music, which permit a user to request a particular piece of music by singing a section of the piece of music, whose title is unknown to him. This method is distinguished in that a tone sequence which corresponds at least in part to at least a section of the tone sequence which is to be selected is entered, the tones in the entered tone sequence are converted into a note sequence, then, to search for the tone sequence which is to be selected, its note sequence is compared successively with corresponding note sequences for a multiplicity of tone sequences in order to ascertain titles for one or more tone sequences whose note sequence or sequences matches or match the note sequence for the tone sequence which is to be selected in a predetermined manner, and the titles ascertained are output as a list or tone sequences, so that a user can use the title list or tone sequence to select the desired tone sequence.

20 Claims, 1 Drawing Sheet

METHOD FOR RECOGNIZING AND SELECTING A TONE SEQUENCE, PARTICULARLY A PIECE OF MUSIC

BACKGROUND OF THE INVENTION

1. Field of the Invention

The invention relates both to a method for recognizing and for selecting a tone sequence, particularly a piece of music.

2. Description of the Prior Art

Today's multimedia services permit their users to retrieve pieces of music, video clips and also graphical information from appropriate databases on appropriate request in order to be able to play back and/or store the desired pieces of music or the like. As data transmission speeds become higher and higher and costs of storage space become lower, it will also be possible in future to retrieve films from appropriate suppliers.

By way of example, it is currently possible on the Internet for a user to have music recordings or the like transmitted to him by an appropriate supplier, said recordings then either being stored in a database belonging to the user or being used to produce a CD. Such a request for pieces of music or the like is also possible using mobile radio services, however.

To obtain a particular music recording, the user needs to enter the name or the title of the piece of music and transmit it to the appropriate service provider. The service provider's database of music recordings is then searched for the requested piece of music in order to transmit it, if it is available in the database, to the user making the request.

In order to be able to supply a desired music recording to a user even when he does not know the title of the piece of music exactly, the search in the service provider's database also includes the use of associative search algorithms which, despite slight discrepancies between the entered title and the actual name of the piece of music, are able to identify the piece of music or at least offer a selection of several pieces of music having similar titles.

If, however, a user wishes to request a piece of music which he likes very much but whose title he does not know, or at best knows only very vaguely, then it is current virtually impossible for him to request this piece of music.

OBJECTS OF THE INVENTION

Against this background, the invention is based on the object of providing methods for recognizing and for selecting a tone sequence, particularly a piece of music, which permit a user to find and select a tone sequence or a piece of music whose title he does not know.

This object is achieved, in terms of recognizing a tone sequence, by the method according to claim 1, and in terms of selecting a tone sequence, by the method according to claim 2. Advantageous refinements and developments of the invention are described in the dependent claims.

BRIEF SUMMARY OF THE INVENTION

Thus, according to the invention, to recognize a tone sequence, the tones in the tone sequence to be recognized are first converted into a note sequence; next, to search for the tone sequence which is to be recognized, its note sequence is compared successively with corresponding note sequences for a multiplicity of tone sequences, and titles are then output for the tone sequence or sequences whose note sequence or sequences matches or match the note sequence for the tone sequence which is to be recognized in a predetermined manner.

The inventive method for selecting a tone sequence uses this recognition method and is distinguished in that a tone sequence which corresponds at least in part to at least a section of the tone sequence which is to be selected is entered, the tones in the entered tone sequence are converted into a note sequence, then, to search for the tone sequence which is to be selected, its note sequence is compared successively with corresponding note sequences for a multiplicity of tone sequences in order to ascertain titles for one or more tone sequences whose note sequence or sequences matches or match the note sequence for the tone sequence which is to be selected in a predetermined manner, and the titles ascertained are output as a list, so that a user can use the title list to select the desired tone sequence.

The basic concept of the present invention is thus that a tone sequence, as presented in audio form to the user and can be reproduced more or less accurately by said user, is first converted into a note sequence, that is to say into a representation as is also used, for example, for writing down pieces of music, and this representation of the desired tone sequence is compared with appropriate note sequences which are associated with individual pieces of music in a database belonging to a service provider, so that it is possible to ascertain the degree of correspondence between the desired tone sequence entered and the pieces of music in order then to output the titles of the tone sequence or sequences which match the desired tone sequence, or the tone sequence which is to be selected, in a predetermined manner.

The invention thus permits a user also to request tone sequences, particularly pieces of music, video clips, and possibly also films using their soundtrack, when only their melody is known to him. The method according to the invention thus permits an intuitive search in databases containing pieces of music or the like, and thus simplifies the use thereof.

In a first refinement of the invention, the tone sequence which has been entered in a user terminal and corresponds to the tone sequence which is to be selected is transmitted to a database station which ascertains the list of titles for one or more tone sequences similar to the tone sequence which is to be selected, and the title list is transmitted to the user terminal for output.

If the user terminal used is a mobile telephone, for example, in order to select a particular piece of music from a service provider using radio channels, then it is advantageous, particularly in terms of good utilization of the transmission link, if the tone sequence which has been entered into a user terminal and corresponds to the tone sequence which is to be selected is converted into a note sequence in the user terminal, the note sequence is transmitted to a database station which ascertains the list of titles for one or more tone sequences similar to the tone sequence which is to be selected, and the title list is transmitted to the user terminal for output.

In order to permit the user also to be able to select a piece of music whose title is not known to him at all, in one particularly advantageous refinement of the invention, a short passage of the tone sequence which is characteristic of the respective tone sequence is transmitted together with each title to the user terminal for output. The user is thus offered not only the title of the respective tone sequence, that is to say the title or titles of the recognized piece of music or possible pieces of music, but rather it is also possible for him to hear a short characteristic passage from the piece of music, for example the main theme or the refrain, so that he can make his selection on the basis of the characteristic tone sequence played back.

It is particularly expedient if, in the method according to the invention, the tone sequence is sung by the user to enter it into the user terminal.

A particularly advantageous refinement of the method according to the invention is distinguished in that, to convert a tone sequence into a note sequence, the pitch frequency $f_p'$ and the tone duration d' are ascertained for each tone in the tone sequence, and each tone is allocated a musical note on the basis of its pitch frequency $f_p$ and a musically quantized note duration d on the basis of a tone duration distribution of the tone sequence.

In this context, it is expedient if, to define the note duration of the tones, the median of the tone duration distribution is first ascertained and the tone duration of the median is equated to the note duration of a ¼ note, and each tone is allocated an appropriate musically quantized note duration by comparing its tone duration with the ascertained note duration of a ¼ note.

Thus, according to the invention, the time profile for the pitch frequency is used to ascertain the respective musical tone or the note, that is to say, for example, C, D, E, F, G, A, B and the note duration d. Since, particularly when the desired tone sequence is sung, the note duration d cannot be measured absolutely, the median is ascertained from the tone duration distribution and is equated to the note duration of a ¼ note. On the basis of this, tone duration intervals can then be stipulated, to which the other customary note durations, that is to say 1/32, 1/16, 1/8, ½ and 1, in particular, can then be allocated.

To carry out the comparison to establish a degree of correspondence in a data processing system, it is particularly expedient if each tone sequence is represented by a pitch vector h, which is made up of the individual notes or musical tones, and a tone duration vector d, which is made up of the musically quantized note durations d of the individual tones.

To be able to compare the note sequence for an entered tone sequence with the note sequences in the stored pieces of music successfully even when the entered tone sequence has consciously or unconsciously been transposed to another register, in one expedient development of the invention, to establish a correspondence factor $F_{i,1}$ between an entered tone sequence and a stored tone sequence, the differences between the pitches h and tone durations d of the respective note sequences are compared with one another.

One practical refinement of the invention is distinguished in that, when the note sequences for an entered tone sequence and in a stored tone sequence are compared, the note sequence for the entered tone sequence is compared successively with corresponding partial note sequences for the stored tone sequences in order to ascertain a respective correspondence factor $f_i(x)$, and in that the correspondence factor $F_{i,1}=f_i(x_1)$ which indicates the highest degree of correspondence is allocated to the stored tone sequence as a correspondence factor.

To implement the invention using data processing systems, it is particularly expedient if the correspondence factor ascertained is the lowest value of a function $f_i(x)$ which is given by the following equation:

$$f_i(x) = \alpha\sum_{l=0}^{N-1} |h(l) - m_h - (h_i(x+l) - m_{h_i}(x))| + \beta\sum_{l=0}^{N-1} |d(l) - m_d - (d_i(x+l) - m_{d_i}(x))|$$

where α and β are weight factors for which: 0<α, β and α+β=1; h(l) is the pitch of the l-th tone in an entered tone sequence, $m_h$ is the median of the pitches in the entered tone sequence, d(l) is the tone duration of the l-th tone in an entered tone sequence, $m_d$ is the median of the tone durations of the entered tone sequence, $h_i$ (x) is the pitch of the x-th tone in a stored tone sequence, $d_i$ (x) is the tone duration of the x-th tone in this stored tone sequence, $m_{hi}$ (x) is the median of the pitches in the interval $h_i$ (x) to $h_i$(x+N−l), $m_{di}$ (x) is the median of the tone durations in the interval $d_i$ (x) to $d_i$(x+N−1).

To make the selection of the piece of music which is being sought even simpler for the user, in one expedient development of the invention, the tone sequence titles which are to be output are sorted according to a degree of correspondence between the associated stored tone sequences and the entered tone sequence, and the output starts with the title whose tone sequence is most similar to the entered tone sequence, with only titles of tone sequences whose degree of correspondence is higher than a prescribed value being output.

One particularly advantageous refinement of the invention is distinguished in that the note sequences for the multiplicity of tone sequences are stored together with corresponding titles for the tone sequences in a database file, with short characteristic passages of the respective tone sequences being stored together with the note sequences stored in the database file.

Thus, according to the invention, a particular database file is provided in which the note sequences in the pieces of music available in a database are stored together with corresponding names, that is to say with the titles of the pieces of music, so that, when the note sequence for the entered tone sequence is compared, the note sequences in the pieces of music do not need to be produced again every time, which means that the search for the desired piece of music can be significantly simplified and speeded up. In addition to the title of the piece of music, each note sequence may also have a short characteristic passage of the respective piece of music associated with it in this particular database file, for example in MIDI format, which means that the database file in which pieces of music are stored as such does not need to be accessed until the user has decided on a specific piece of music.

BRIEF DESCRIPTION OF THE SEVERAL VIEWS OF THE DRAWINGS

The invention is explained in more detail below by way of example with reference to the drawing, in which.

DETAILED DESCRIPTION OF THE INVENTION

Figure 1:
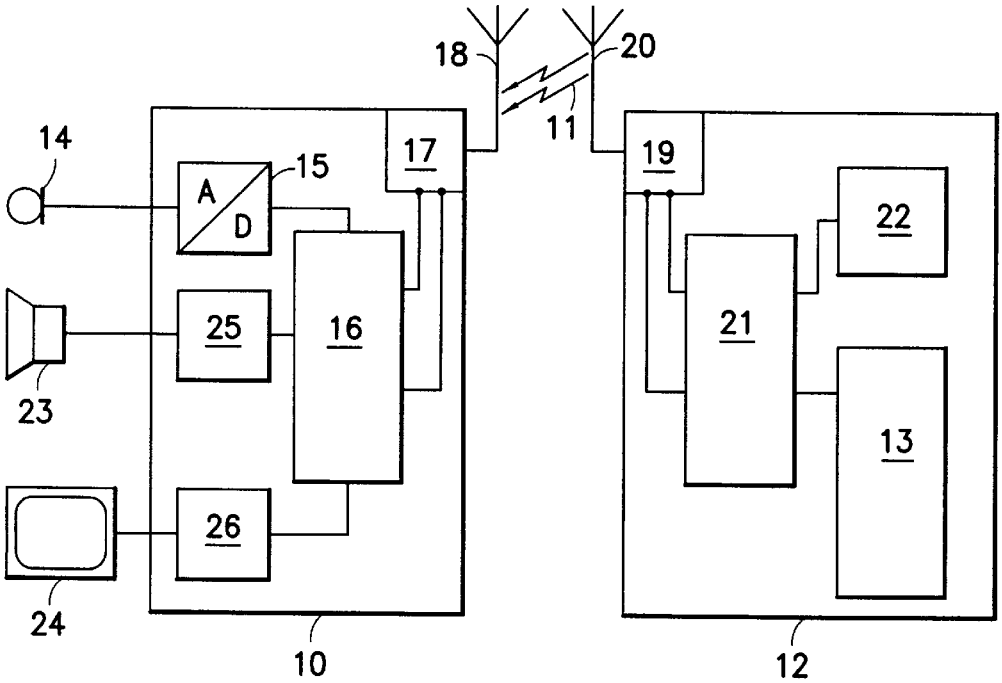
FIG. 1 shows a schematic block diagram of a communication system for carrying out the methods according to the invention.

FIG. 1 shows an example of a communication system in which a user can use a user terminal, in the form of a mobile telephone 10, for example, to communicate over a transmission link 11 with a service provider's database station 12, which comprises a music database 13, in order to receive pieces of music, video clips, and possibly films or the like.

In the customary manner, the mobile telephone 10 has a microphone 14 for entering speech and sound, the output of said microphone being connected to a central processing circuit 16 via an analogue/digital converter 15. The central processing circuit 16, which may be in the form of a microprocessor, for example, outputs data which is to be transmitted to the service provider's database station 12 to a transceiver unit 17 to which a transmission and reception antenna 18 is connected for the purpose of transmitting information over the transmission link 11 and receiving information from said transmission link 11.

The service provider's database station 12 has a transceiver unit 19 having a transmission and reception antenna 20 in order to be able to receive and send data from and over the transmission link 11. The transceiver unit 19 is connected to a central processing circuit 21 which can access the music database 13 in order to transmit a requested piece of music to the mobile telephone 10.

For recognizing pieces of music, there is a database file 22 which, together with the names or titles of the individual pieces of music in the music database 13, stores note sequences corresponding to the pieces of music. In this context, characteristic passages from the pieces of music may also be stored together with the titles and note sequences of the pieces of music.

For the audio and visual output of information, the mobile telephone 10 has a loudspeaker 23 and a display device 24, which are connected to the central processing circuit 16 via appropriate driver circuits 25 and 26, respectively.

To request a particular piece of music from a service provider, the user first enters a passage of the piece of music which is to be selected or is desired by simply singing the melody known to him into the microphone 14. The human voice recorded by the microphone is digitized by means of the analogue/digital converter 15 and is supplied to the central processing circuit 16, which thus receives the digitized frequency profile for the human voice.

A pitch detector in the central processing circuit 16 is used to ascertain the time profile for the pitch frequency of the tone sequence sung into the microphone 14 from the digitized frequency profile for the human voice. In this context, the pitch detector used is, by way of example, the so-called SIFT (Simplified Inverse Filter Tracking) algorithm, which is particularly well suited to relatively high female voices, or the so-called Cepstrum pitch estimation, which is suitable for relatively low male voices. These methods are familiar to the competent person skilled in the art, and are explained, for example, in the textbook "Voice and Speech Processing", Thomas W. Parsons, New York, 1986, McGraw-Hill Book Company.

The ascertained profile for the pitch frequency $f_p$ is then smoothed using a suitable filter. In particular, a median filter is used for this, in which a filter window slides over the pitch frequency curve which is to be smoothed, in order to replace the value in the centre of the window in each case with the median of all the values in the window. Such median filtering is likewise known and explained in the aforementioned textbook.

Figure 2:
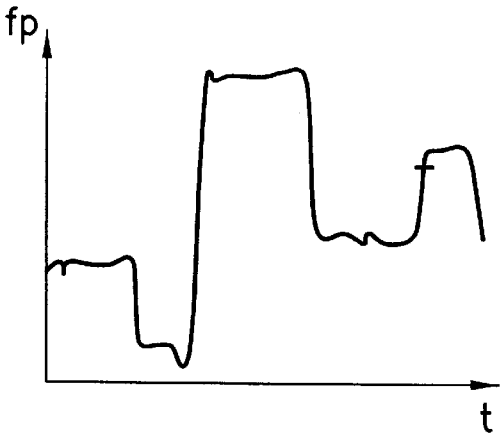
FIG. 2 shows the time profile for a smoothed pitch frequency.

After smoothing, a profile for the pitch frequency $f_p$, as shown purely schematically in FIG. 2, is produced. Thus, a smoothed profile for the pitch frequencies of the sung tone sequence over time is produced, which ideally coincides with the profile for the melody in the frequency range.

Figure 3:
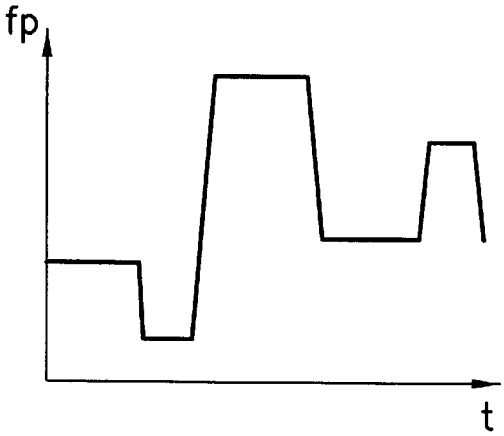
FIG. 3 shows the time profile for a pitch frequency quantized on the basis of the musical notes or tones.

Since, however, conscious and unconscious transposition of the melody by the user when singing, and differences in rhythm and tempo, produce errors or discrepancies between the sung melody and the desired melody, the profile of the pitch frequencies which is shown in FIG. 2 is quantized on the basis of the frequencies of the musical tones or notes, with the result that the quantized profile shown in FIG. 3 for the pitch frequencies $f_p$ over time is produced. In this case, FIG. 3 shows, by way of example, five different tones having various tone durations, each of which can be allocated a particular musical tone or a note and a particular tone duration.

After the profile of the pitch frequency has been quantized, the sung tone sequence entered can be broken down into a particular number N of individual tones. In this context, each of these individual tones is allocated a musical tone according to the musical scale. In addition, each of the individual tones has a particular tone duration, from which a corresponding note duration can be ascertained.

Each tone is thus distinguished by two quantities, namely by the pitch or pitch frequency, denoted by the corresponding musical tone or the corresponding note, and by the tone duration, which is quantized on the basis of the musical note duration in a manner which is yet to be described. This means that each tone sequence, comprising N tones, can be described by a pitch vector $h=(h_1, h_2, \ldots h_N)^T$ and by a tone duration vector $d=(d_1, d_2, \ldots d_N)^T$. In this case, the values $h_1$ may simply be integers representing the respective musical tones or notes on the basis of the table below.

| Note | A' | A# | B' | C' | C# | D' | D# | E' | F' | F# | G' | G# | A" | A# | B" |
|---|---|---|---|---|---|---|---|---|---|---|---|---|---|---|---|
| Number | 0 | 1 | 2 | 3 | 4 | 5 | 6 | 7 | 8 | 9 | 10 | 11 | 12 | 13 | 14 |

Accordingly, each note duration 1/32, 1/16, 1/8, 1/4, 1/2, 1 can be allocated a corresponding number, with the duration 1 being expediently set for the shortest note. A 1/4 note is then given the duration 8, a 1/2 note is given the duration 16 and the whole note is given the duration 32. To be able to allocate a musical note duration to the individual tone durations, the median of the tone duration distribution is ascertained and is equated to a 1/4 note. On the basis of the median, time intervals are then established which correspond to the individual note durations.

The sung tone sequence is now available as a note sequence which can be described by two extremely simple vectors.

In this context, the conversion of the tone sequence into the vectors describing the note sequence can be carried out in the central processing circuit 21 in the service provider's database station 12. However, in order to load the transmission link 11 as little as possible, that is to say in order to block the corresponding transmission channels as little as possible, this conversion is carried out in the actual mobile telephone 10 by the central processing circuit 16, which means that only the pitch vector and the note duration vector need to be transmitted to the service provider's database station 12.

The database station 12 stores the pieces of music in the database file 22 as note sequences, which are likewise described by an appropriate pitch vector $h_i=(h_{i1}, h_{i2}, \ldots h_{ix}, \ldots h_{iM})$ and tone duration vectors $d_i=(d_{i1}, d_{i2}, \ldots d_{ix}, \ldots d_{iM})$ . In this context, the index i denotes the respective piece of music and M denotes the number of tones or notes.

So that entered tone sequences which have been consciously or unconsciously transposed can also be compared with the pieces of music, it is not the respective note sequences which are compared with one another directly, but rather only the relative profile within the two note sequences. To this end, the respective differences between the individual pitches are compared with one another. Thus, the median is established for each note sequence in order to ascertain the gap between the individual tones and the median and to compare it with the gap between the corresponding other tone from the other note sequence and its median. Since the note sequence in the piece of music is typically much longer than the note sequence entered by singing, for example, the median of an appropriate subsection of the note sequence in the piece of music is used for this note sequence in each case.

During the practical comparison of the note sequence for an entered tone sequence with the note sequences in the pieces of music, a function fi(x) is calculated, whose profile indicates how the note sequence for the entered tone sequence matches the individual sections. This discrepancy function is calculated on the basis of the following equation:

$$f_i(x) = \alpha\sum_{l=0}^{N-1} |h(l) - m_h - (h_i(x+l) - m_{h_i}(x))| + \beta\sum_{l=0}^{N-1} |d(l) - m_d - (d_i(x+l) - m_{d_i}(x))|$$

Here, $\alpha$ and $\beta$ are weight factors describing the effect of the melody and of the rhythm on the correspondence factor. For $\alpha$ and $\beta$, the following is true here: $0<\alpha, \beta; \alpha+\beta=1$. $h_i(x)$ and $d_i$ (x) denote the pitch and the tone duration of the x-th tone in the vector $h_i$ and $d_i$, respectively. $m_{ni}$ (x) and $m_{di}$ (x) respectively denote the median of the pitches and tone durations in the interval from $h_i$ (x) to $h_i$ (x+N−1) and $d_i$ (x) to $d_i$ (x+N−1), respectively. h(1) and d(1) denote the pitch and tone duration of the l-th tone in the vector h and d, respectively. Similarly, $m_h$ and $M_d$ denote the median of the pitches and tone durations in the vector h and in the vector d, respectively.

Both for the pitches and for the tone durations, the sum of the differences between the respective gaps from the appropriate median is calculated in each case; ideally, that is to say when the note sequences match one another exactly, this sum becomes equal to 0.

After the function $f_i$ (x) has been calculated for all the values x, that is to say when the note sequence for the entered tone sequence has been compared with all possible sections of the note sequence in a piece of music in the manner described by the above equation, the smallest value of the function $f_i$ (x) is established. The associated value $x_1$ thus describes that section of the note sequence which (possibly) corresponds to the section of the piece of music sung by the user. The associated value of the function $f_i$ (x) is then stored as discrepancy factor $F_{i,1}=f_i$ ($x_1$).

As soon as the note sequence for the entered tone sequence has been compared with all the note sequences in the individual pieces of music, the names or titles of the pieces of music are sorted according to the correspondence factors $F_{i,1}$ ascertained, starting with the smallest discrepancy factor, which denotes the highest degree of correspondence.

In order subsequently to present the pieces of music to the user in the order ascertained, they are transmitted from the database station 12 to the mobile telephone 10, where the titles are displayed on the display device 24 while characteristic passages of the pieces of music can be output over the loudspeaker 23. In this context, the number of titles transmitted is expediently limited. In this regard, the limitation can be effected most simply by transmitting only a limited fixed number of titles for the pieces of music to the mobile telephone, depending on the display and storage capacities. However, it is also possible for the limitation to be based on the discrepancy factor, so that only titles of pieces of music whose discrepancy factor does not exceed a predetermined threshold value are transmitted to the mobile telephone and displayed to the user. Such a threshold value can be defined generally or can be ascertained on the basis of the discrepancy factor distribution.

The present invention thus permits recognition of pieces of music in a service provider's database station, with a user singing only part of a desired piece of music when he does not know the title of this song or piece of music. Once the piece of music, or a series of possible pieces of music, have been recognized, the title or titles is or are transmitted to the user, possibly together with characteristic passages of the pieces of music, so that the user can select the desired piece of music therefrom. After selection, the complete piece of music is then sent via electronic communication paths (Internet, cellular mobile telephone network, as in the illustrative embodiment described, or the like) and the user can permanently store the piece of music on a suitable storage medium (CD, memory module, magnetic tape etc.) and play it back.

For comparison of the entered tone sequence, that is to say of a sung section of the desired piece of music, with the pieces of music in the service provider's database station, the database station 12 is provided with a separate database file 22 which stores the titles or names of the individual pieces of music with the associated note sequences, so that the desired pieces of music are much simpler to find and recognition is speeded up.

What is claimed is:

1. Method for recognizing a tone sequence, particularly a piece of music, comprising the steps of:

converting the tones in the tone sequence to be recognized into a note sequence by:

ascertaining the pitch frequency $f_p$ and the tone duration for each tone in the tone sequence, allocating to each tone a musical note on the basis of its pitch frequency $f_p$ and a musically quantized note duration on the basis of a tone duration distribution of the tone sequence, and defining the note duration of the tones by:

first ascertaining the median of the tone duration distribution, equating the tone duration of the median to the note duration of a ¼ note, and comparing the tone duration of each tone allocated an appropriate musically quantized note duration comprising 1/32, 1/16, 1/8, ¼, ½, 1, with an ascertained note duration of a ¼ note, searching for the tone sequence which is to be recognized by comparing its note sequence successively with corresponding note sequences for a multiplicity of tone sequences, and outputting titles for the tone sequence or sequences whose note sequence or sequences matches or match the note sequence for the tone sequence which is to be recognized in a predetermined manner.

2. Method according to claim 1, characterized in that, to establish a discrepancy factor $F_{i,l}$ between an entered tone sequence and a stored tone sequence, the differences between the pitches and tone durations of the respective note sequences are compared with one another.

3. Method according to claim 2, characterized in that the discrepancy factor ascertained is the lowest value of a function $f_i(x)$ which is given by the following equation:

$$f_i(x) = \alpha \sum_{l=0}^{N-1} |h(l) - m_h - (h_i(x+l) - m_{h_i}(x))| + \beta \sum_{l=0}^{N-1} |d(l) - m_d - (d_i(x+l) - m_{d_i}(x))|$$

where $\alpha$ and $\beta$ are weight factors for which: $0<\alpha$, $\beta$ and $\alpha+\beta=1$; h(l) is the pitch of the l-th tone in an entered tone sequence, $m_h$ is the median of the pitches in the entered tone sequence, d(l) is the tone duration of the l-th tone in an entered tone sequence, $m_d$ is the median of the tone durations of the entered tone sequence, $h_i(x)$ is the pitch of the x-th tone in a stored tone sequence, $d_i(x)$ is the tone duration of the x-th tone in this stored tone sequence, $m_{hi}(x)$ is the median of the pitches in the interval $h_i(x)$ to $h_i(x+N-l)$, $m_{di}(x)$ is the median of the tone durations in the interval $d_i(x)$ to $d_i(x+N-1)$.

4. Method according to claim 1, characterized in that, when the note sequences for an entered tone sequence and in a stored note sequence are compared, the note sequence for the entered tone sequence is compared successively with corresponding partial note sequences for the stored tone sequences in order to ascertain a respective discrepancy factor $f_i(x)$, and in that the smallest discrepancy factor $F_{i,l}=f_i(x_l)$, which indicates the highest degree of correspondence, is allocated to the stored tone sequence as a discrepancy factor.

5. Method according to claim 1, further comprising the steps of:

sorting the tone sequence titles which are to be output according to a degree of correspondence between the associated stored tone sequences and the entered tone sequence, and starting the output with the title whose tone sequence is most similar to the entered tone sequence.

6. Method according to claim 1, further comprising the step of outputting only titles of tones sequences whose degree of correspondence is higher than a prescribed value.

7. Method according to claim 1, further comprising the step of storing together the note sequences for the multiplicity of tone sequences with corresponding titles for the tones sequences in a database file.

8. Method according to claim 7, further comprising the step of storing together short characteristic passages of the respective tone sequences with the note sequences stored in a database file.

9. Method according to claim 1, wherein each tone sequence is represented by a pitch vector h, which is made up of the individual notes or musical tones, and a tone duration vector d, which is made up of the musically quantized note durations of the individual tones.

10. Method according to claim 1, further comprising the step of outputting only titles of tones sequences whose degree of correspondence is higher than a prescribed value.

11. Method for selecting a tone sequence, particularly a piece of music, comprising the steps of:

entering a tone sequence which corresponds at least in part to at least a section of the tone sequence to be selected, converting the tones in the entered tone sequence into a note sequence by:

ascertaining the pitch frequency $f_p$ and the tone duration for each tone in the tone sequence, allocating each tone a musical note on the basis of its pitch frequency $f_p$ and musically quantized note duration on the basis of a tone duration distribution of the tone sequence, and defining the note duration of the tones by:

first ascertaining the median of the tone duration distribution, equating the tone duration of the median to the note duration of a ¼ note, and searching for the tone sequence which is to be selected by comparing its note sequence successively with corresponding note sequences for a multiplicity of tone sequences, in order to ascertain titles for one or more tone sequences whose note sequence or sequences matches or match the note sequence of the tone sequence which is to be selected in a predetermined maner, an outputting the titles ascertained as a list, so that a user can use the title list to select the desired tone sequence.

12. Method according to claim 11, further comprising the steps of:

transmitting the tone sequence which has been entered into a user terminal and corresponds to the tone sequence which is to be selected, to a database station which ascertains the list of titles for one or more tone sequences similar to the tone sequence which is to be selected, and transmitting the title list to the user terminal for output.

13. Method according to claim 12, further comprising the steps of:

transmitting a short passage of the tone sequence which is characteristic of the respective tone sequence together with each title to the user terminal for output.

14. Method according to claim 11, further comprising the steps of:

converting the tone sequence which has been entered into a user terminal and corresponds to the tone sequence which is to be selected, into a note sequence in the user terminal, transmitting the note sequence to a database station which ascertains the list of titles for one or more tone sequences similar to the tone sequence which is to be selected, and transmitting the title list to the user terminal for output.

15. Method according to claim 14, further comprising the steps of:

transmitting a short passage of the tone sequence which is characteristic of the respective tone sequence together with each title to the user terminal for output.

16. Method according to claim 11, wherein the tone sequence is sung by the user to enter it into the user terminal.

17. Method according to claim 11, wherein each tone sequence is represented by a pitch vector h, which is made up of the individual notes or musical tones, and a tone duration vector d, which is made up of the musically quantized note durations of the individual tones.

18. Method according to claim 2, further comprising the step of storing together the note sequences for the multiplicity of tone sequences with corresponding titles for the tones sequences in a database file.

19. Method according to claim 18, further comprising the step of storing together short characteristic passages of the respective tone sequences with the note sequences stored in a database file.

20. Method according to claim 11, further comprising the steps of:

sorting the tone sequence titles which are to be output according to a degree of correspondence between the associated stored tone sequences and the entered tone sequence, and starting the output with the title whose tone sequence is most similar to the entered tone sequence.

* * * * *